US008188681B2

(12) United States Patent
Weger

(10) Patent No.: US 8,188,681 B2
(45) Date of Patent: May 29, 2012

(54) ELECTRONIC CIRCUIT FOR OPERATING A PLURALITY OF GAS DISCHARGE LAMPS ACROSS A COMMON VOLTAGE SOURCE

(75) Inventor: Robert Weger, Wels (AT)

(73) Assignee: Minebea Co., Ltd., Nagano-ken (JP)

( * ) Notice: Subject to any disclaimer, the term of this patent is extended or adjusted under 35 U.S.C. 154(b) by 562 days.

(21) Appl. No.: 12/321,696

(22) Filed: Jan. 22, 2009

(65) Prior Publication Data

US 2009/0184661 A1 Jul. 23, 2009

(30) Foreign Application Priority Data

Jan. 23, 2008 (DE) ..... 10 2008 005 792

(51) Int. Cl.
*H05B 41/36* (2006.01)

(52) U.S. Cl. ..... 315/299; 315/300; 315/311

(58) Field of Classification Search ..... 315/88–90, 315/177, 185 R, 189, 193, 209 R, 210, 226, 315/209 T, 246, 250, 287, 291, 299, 312, 315/313, 320, 324, 326

See application file for complete search history.

(56) References Cited

U.S. PATENT DOCUMENTS

| | | | | |
|---|---|---|---|---|
| 4,272,807 | A * | 6/1981 | Gallagher | 363/126 |
| 4,998,074 | A * | 3/1991 | Van Lammeren et al. | 330/252 |
| 6,420,839 | B1 | 7/2002 | Chiang | |
| 7,268,501 | B1 | 9/2007 | Chen | |
| 2008/0116821 | A1 | 5/2008 | Weger | |

FOREIGN PATENT DOCUMENTS

| | | |
|---|---|---|
| DE | 102007054273 | 5/2008 |
| EP | 1951006 | 7/2008 |
| JP | 2004071226 | 3/2004 |
| WO | 2007055289 | 5/2007 |

* cited by examiner

*Primary Examiner* — Douglas W Owens
*Assistant Examiner* — Jianzi Chen
(74) *Attorney, Agent, or Firm* — Cooper & Dunham LLP

(57) ABSTRACT

The proposed circuit makes it possible to operate a plurality of gas discharge lamps, particularly cold cathode tubes, across a common voltage source. The circuit reduces the resistance tolerance of the lamp characteristic curves through controlled debalancing of the lamp currents with the aid of debalancing modules. Through the active reduction in the resistance tolerance, the requirements placed on the electric strength of the balancing transistors as well as energy losses of the balancing circuit are reduced.

9 Claims, 4 Drawing Sheets

ELECTRONIC CIRCUIT FOR OPERATING A PLURALITY OF GAS DISCHARGE LAMPS ACROSS A COMMON VOLTAGE SOURCE

BACKGROUND OF THE INVENTION

The invention relates to an electronic circuit for operating a plurality of gas discharge lamps across a common voltage source.

PRIOR ART

The light for backlighting liquid crystal displays is commonly generated by a series of lamps of the same kind taking the form of cold cathode tubes having a fluorescent coating (CCFL). Depending on the size of the display, up to 32 tubes, for example, may be used, the tubes being arranged equidistant and parallel to each other. The cold cathode tubes are typically supplied with a current of a few milliamperes and an ac voltage of approximately 1 kV at a frequency of between 30 and 60 kHz. In order to achieve the best possible light homogeneity, all the tubes have to be operated as far as possible at the same current intensity. Permissible current tolerance is typically ±5%. An obvious technical solution is to provide each lamp with its own current-regulated high voltage supply having its own main bridge and its own high voltage transformer. However, due to cost considerations, preferred solutions are those in which only one efficient main bridge and only a single common high voltage transformer for all lamps are required. Due to their negative differential resistance, however, gas discharge tubes cannot simply be connected in parallel but rather auxiliary circuits have to be used that distribute the current symmetrically to the plurality of lamps. The simplest means of creating a balancing auxiliary circuit is to provide a small series capacitor at each tube. The quality of this balancing method, however, is poor and the transformer has to be dimensioned for a considerably higher voltage than the lamp voltage.

A high-quality method provides the use of cascaded or linked current balancing transformers such as described in WO 2005/038828. FIG. 1 shows an example of this kind of circuit for the lamps. The overall current is evenly distributed by a plurality of similar transformers to the plurality of lamps. A shortcoming of this method is the large number of balancing transformers needed, each of which being nevertheless dimensioned for several hundred volts. Attempts have therefore been made to replace the balancing transformers by semi-conductor circuits. A well-functioning method related to the classic current mirror method has been presented in Patent Application DE 10 2006 040026 (Weger) that has not been pre-published. In this method, as can be seen from FIG. 2, collector-emitter sections of bipolar transistors are connected in series to each lamp, where the transistors dynamically equalize the differences in the forward resistance of the tubes thus making it possible to have the same lamp currents in all channels. The disadvantage of this current balancing method is that power losses occur at the balancing transistors that are proportional to the voltage drops across the collector-emitter sections. Alongside a loss in efficiency, the cost advantage of this semi-conductor circuit over the magnetic solutions is also reduced in that such measures as higher electric strength of the balancing transistors are needed. This is where the present invention finds application.

SUMMARY OF THE INVENTION

According to the prior art, balancing circuits equalize the differing resistances of the lamps by means of the balancing transistors connected in series to the individual lamps, where the transistors act as dynamic resistors.

It is the object of the invention to provide a method, or an electronic circuit implementing this method, by means of which the resistances of the lamps themselves are influenced in the way of an alignment. This would drastically reduce the need to equalize the remaining differences in resistance and thus also reduce the voltage drops or power losses at the balancing transistors.

This object has been achieved according to the invention by an electronic circuit having the characteristics outlined in claim 1. A method for operating the circuit is cited in a further independent claim.

Preferred embodiments and advantageous characteristics of the invention are revealed in the subordinate claims.

According to the invention, a balancing circuit based on a circuit revealed in DE 10 2006 040026 is presented. The circuit according to the invention makes use of the current and temperature dependence of the lamp resistance and achieves an alignment of the resistance tolerance of the lamps by means of specific debalancing of the lamp currents within its current tolerance range. This goes to reduce the overall power loss of the circuit and allow the use of low-cost semi-conductor components.

The invention proposes debalancing modules that are connected in parallel to the collector-emitter sections of the balancing transistors of each channel. Using the debalancing modules, the individual lamp currents through the gas discharge lamps are debalanced in a controlled way such that the setpoint value of the current flowing through each lamp increases monotonically with the impedance of the lamp.

The invention preferably forms a part of an electronic current balancing circuit by means of which the alternating current through each lamp is separated into its positive and negative half cycles using diodes, the positive half cycles being conducted back via the collector-emitter section of an npn transistor and an emitter resistor to the voltage source and the negative half cycles being conducted back via the collector-emitter section of an pnp transistor and an emitter resistor. The base terminals of all npn transistors and the base terminals of all pnp transistors are electrically connected to one another, wherein the common base currents for the interconnected transistors derived from the lamp current of a gas discharge lamp have to overcome a potential step. For this purpose, an electronic component (e.g. a zener diode) or a circuit part between the base and the collector terminal that generates a voltage potential step is associated with each of the transistors, the component or circuit part having high impedance below a specific voltage potential and low impedance above this level.

The current balancing circuit can alternatively be designed such that for each gas discharge lamp, a half cycle of the input alternating current is conducted via a first diode through the lamp and a first transistor and the other half cycle via a second diode through the lamp and a second transistor. The base terminals of all first transistors Qu and the base terminals of all second transistors Qo are electrically connected to one another. The common base currents of the interconnected transistors derived from the lamp current of a gas discharge lamp have to overcome a potential step.

In the described circuit, the current flows through each lamp and through a balancing circuit having at least one transistor connected in series to the lamp and an emitter resistor connected to the emitter terminal of the transistor. According to the invention, an additional current from an external source is fed in at the emitter terminal of the transistor, this current increasing monotonically with the voltage drop across the collector-emitter section of the transistor of the balancing circuit.

To supply the additional current, a voltage divider is preferably connected in parallel to the collector-emitter section of the transistor of the balancing circuit, the voltage divider consisting of two resistors and a diode where necessary and generating a bypass current proportional to the collector-emitter voltage of the transistor. The bypass current is supplied to a current mirror circuit, consisting of at least one further transistor and a third resistor, by means of which the additional current is generated from an auxiliary voltage source and fed in at the emitter terminal of the transistor of the balancing circuit The lamps are preferably supplied from an ac voltage source, the positive and the negative half cycles of the ac voltage being debalanced separately. A dc voltage source may, however, also be used to supply the current of the lamps.

An appropriate method for operating a plurality of gas discharge lamps across a common voltage source using controlled lamp current debalancing is also claimed.

DESCRIPTION OF PREFERRED EMBODIMENTS OF THE INVENTION

Figure 1:
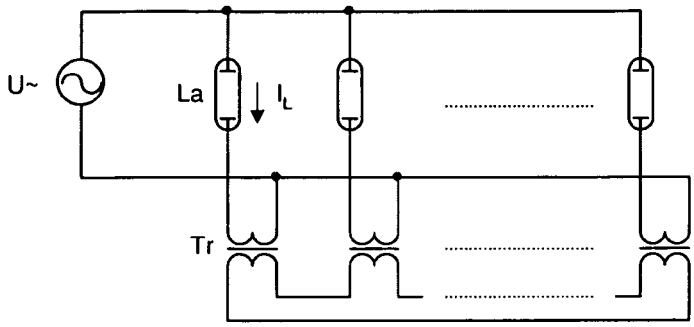
prior art Fig. 1
FIG. 1 shows a current balancing circuit according to the prior art for operating a plurality of gas discharge lamps across a common voltage source using balancing transformers.
Figure 2:
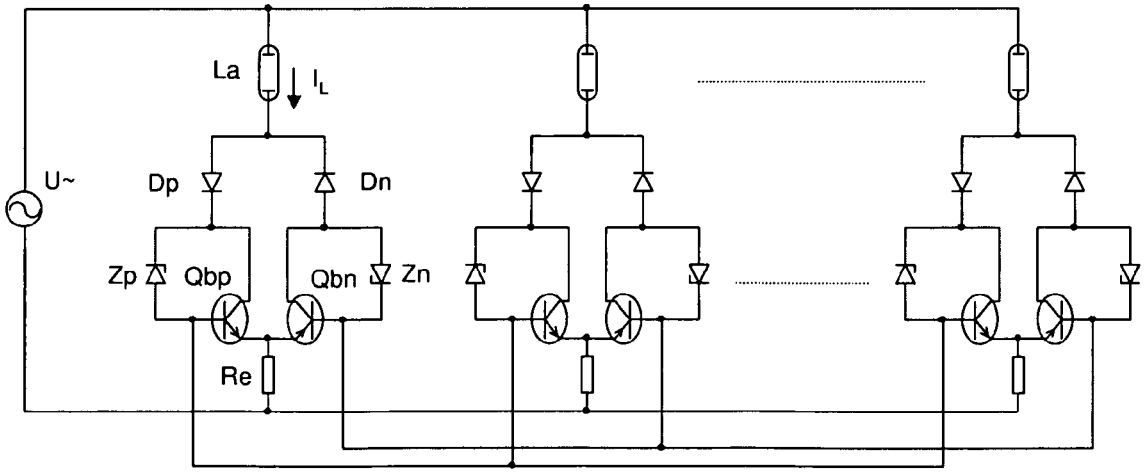
prior art Fig. 2
FIG. 2 shows a balancing circuit based on semi-conductors according to an older development of the inventor that has not been pre-published.

The invention can be employed in all those balancing circuits that balance the lamp currents through series-connected transistors having an emitter resistor and where the base potentials of the transistors are identical. In FIG. 2, an example of such a circuit is illustrated to which the debalancing method according to the invention may be applied. For each gas discharge lamp La (channel, lamp branch), an npn transistor Qbp and an pnp transistor Qbn are used as central components. Generally speaking, each lamp branch or channel respectively has the following part circuit: two diodes Dp and Dn separate the ac voltage U~ across the lamp La into its positive and negative current half cycles. The ac voltage U~ is supplied by a high voltage source, such as a high voltage transformer. The positive half cycles go through the npn transistor Qbp, the negative through the pnp transistor Qbn. Both the positive and the negative half cycles are conducted back to the voltage source via an emitter resistor Re common to the two transistors Qbp, Qbn. The base terminals of the npn transistors Qbp of all lamp branches are connected to each other (p current mirror). The base terminals of the pnp transistors Qbn of all lamp branches are likewise connected to one another (n current mirror). The base terminal of each npn transistor Qbp is connected using a zener diode Zp to the collector terminal of the same transistor Qbp. The base terminal of each pnp transistor Qbn is connected using a zener diode Zn to the collector terminal of the same transistor Qbn. All zener diodes Zp and Zn have the same nominal zener voltage, typically in the range of 100-300 volts. These zener diodes Zp, Zn are of crucial importance to the functioning of the circuit particularly since the current separating effect of the circuit is still present even if the channel having the highest impedance is not known or should it change during operation. The circuit functions as follows: as long as the voltage drop between the collector and emitter of the transistors Qbp and Qbn lies below the zener voltage of the zener diodes Zp and Zn, all the transistors are blocked since no base current flows. If the voltage half cycle of the common lamp supply voltage U~ now rises, the zener voltage is first reached in the channel having the lowest impedance lamp La and the relevant zener diode Zp or Zn respectively becomes conductive and the associated transistor Qbp or Qbn respectively activated. Since the base terminals of all npn or pnp transistors Qbp and Qbn are connected to one another, all the interconnected transistors Qbp or Qbn respectively are activated via the zener diode that first becomes conductive and their base currents begin to flow. The zener diode that is the first to become conductive thus triggers all the base terminals of the interconnected transistors, one zener diode for the positive and one zener diode for the negative half cycle respectively. At this stage, the collector voltages at the other lamp channels with higher impedance are slightly lower than the zener voltage. Due to the identical base voltages (the base terminals are connected directly to each other) and the same emitter resistance, the emitter currents in all transistors Qp or Qn connected to each other at their base terminals are identical. As long as none of the transistors enters saturation, i.e. none are fully switched on, this also applies to the collector currents and thus to the lamp currents $I_L$ as well. In this case, the lamp currents $I_L$ are kept the same size (balanced) by the circuit in each lamp branch. The circuit loses its function of uniformly distributing the current as soon as the difference in voltage between the collector and the emitter in one of the channels approaches zero. This situation is more likely to occur the lower the level of the zener voltage and the greater the tolerance in the lamp characteristics. By choosing a sufficiently high zener voltage level, an extremely reliable current distribution can be achieved. However, energy losses across the circuit also increase in line with a rising zener voltage level. This means that in dimensioning the circuit, the zener voltage level has to be chosen according to the operating parameters and the tolerance of the lamps.

Figure 3:
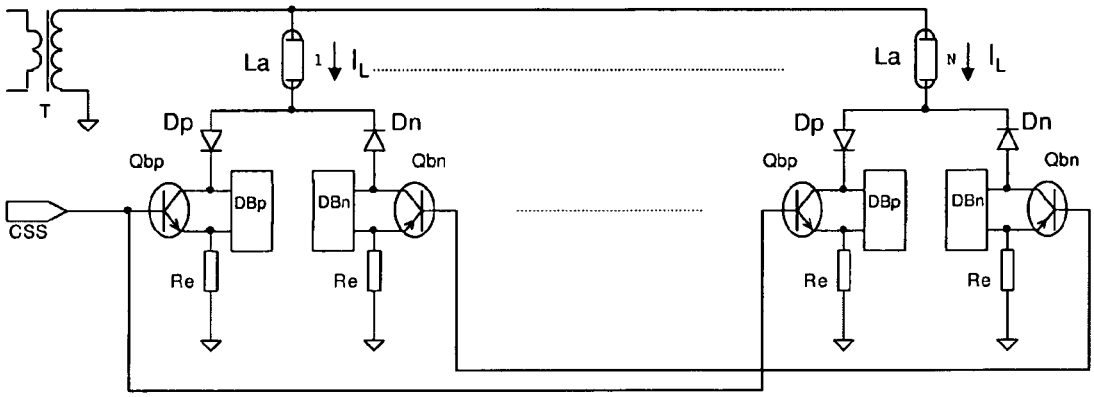
FIG. 3 shows a current balancing circuit according to the invention having specific debalancing of the individual channels. The elements generating the potential steps have been omitted here for the sake of clarity.

FIG. 3 schematically shows the circuit according to the invention by means of which the tolerances of the forward resistance of the individual lamps can be balanced. The circuit according to FIG. 2 is enhanced by two debalancing modules DBp and DBn per lamp branch. The provision of base currents via elements (e.g. zener diodes) generating potential steps is no longer shown in FIG. 3 for the sake of clarity. The debalancing modules DBp and DBn are connected in parallel to the collector-emitter section of the transistors Qbp and Qbn of each channel. The base voltage CSS for the transistors is generated, for example, by zener diodes Zp or Zn according to FIG. 2.

Figure 4:
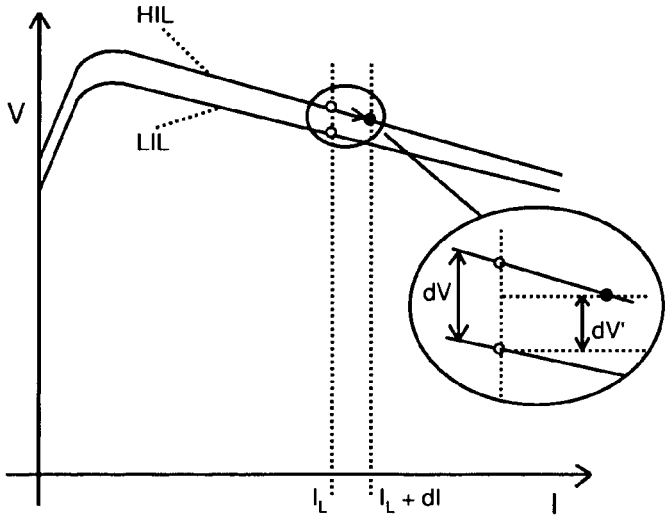
FIG. 4 shows examples of typical characteristic curves of two gas discharge lamps.

The basic idea behind the invention is made clear by FIG. 4. Illustrated here by way of example are typical characteristic curves of two cold cathode fluorescent lamps. Voltage V is plotted against current I. The top characteristic HIL characterizes the lamp having the higher impedance. The lower characteristic LIL belongs to the lamp having lower impedance. With the same lamp current $I_L$, a voltage higher by dV lies across the higher impedance lamp (characteristic HIL). For each lamp, the lamp resistance $R_L=V_L/I_L$ evidently falls with the lamp current $I_L$. If, however, the higher impedance lamp (characteristic HIL) is now operated at a somewhat higher current $I_L$+dI, its resistance (or impedance) decreases. This results in a reduction in the difference in voltage between the two characteristics from dV to dV'. The difference in voltage dV or dV' respectively appears at the collector-emitter section of the balancing transistors Qbp and Qbn as balancing voltage and is responsible there for the required electric strength of the transistors and the balancing losses. Alongside the direct effect of the reduction in balancing voltage, by shifting the operating point of the higher impedance lamp (characteristic HIL) from $I_L$ to $I_L$+dI, more power is released in this lamp than in the low impedance lamp (characteristic LIL). This causes the temperature to rise in the higher impedance lamp, which in turn leads to a characteristic drift in the direction of the low impedance lamp, since an increase in lamp temperature reduces lamp resistance at all operating points. In summary, through the described current debalancing, the lamp resistances are aligned and the balancing voltages reduced.

Figure 5:
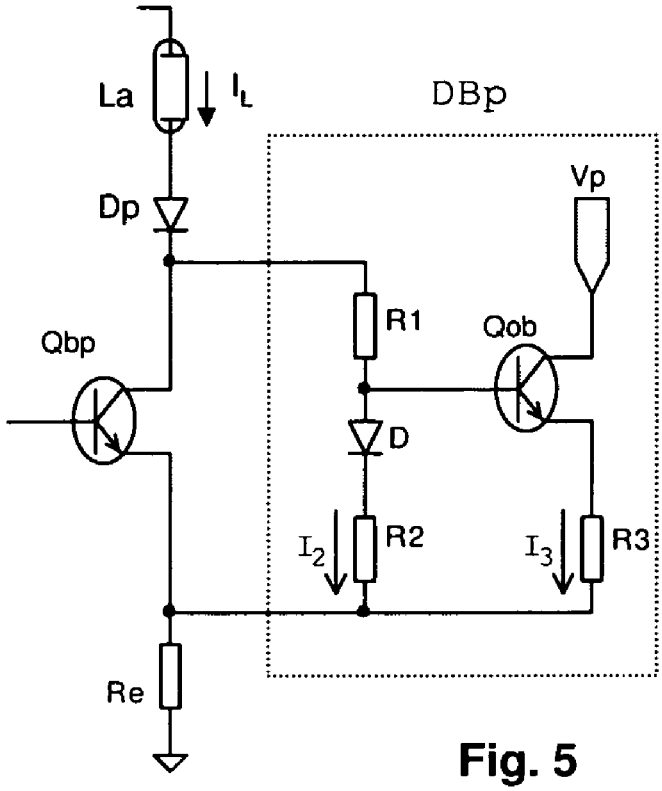
FIG. 5 shows an exemplary design of a current balancing circuit having a debalancing module.

The implementation of the debalancing module DBp in a circuit is shown by way of example in FIG. 5 for the positive half cycle of a lamp branch. The circuit part DBp framed by a broken line is connected in parallel to the collector-emitter section of each transistor Qbp. The debalancing module DBp shifts the setpoint value of the lamp current $I_L$ of the lamps having lower impedance to smaller values. The functioning is explained as follows: the balancing transistor Qbp regulates the current through the emitter resistor Re, so that the voltage drop at resistor Re by the base emitter voltage (diode threshold voltage (approx. 600 mV)) remains below the base potential of the transistor Qbp. Via a voltage divider, formed by the resistors R1 and R2 and a diode D, a small part $I_2$ (e.g. 5%) of the lamp current $I_L$ is now bypassed around the collector-emitter section of the balancing transistor Qbp (bypass current). Since the bypass current $I_2$ also flows via the resistor Re to ground, the regulating behavior of the balancing transistor Qbp is not disrupted by this. The transistor Qob with a resistor R3 at the emitter terminal forms a multiplying current mirror for the bypass current $I_2$. The multiplication factor is mainly determined by the ratio of the resistors R2/R3. Should a ratio, for example, of R2/R3=1 be chosen, due to the effect of the current mirror, an additional current $I_3$ of the same size as the bypass current $I_2$ is conducted via the resistor Re. This additional current $I_3$ is drawn from an external auxiliary voltage source Vp. Since, however, the balancing transistor Qbp regulates the overall current through Re, the lamp current $I_L$ is reduced by the amount of the current $I_3$ fed in via the current mirror. The bypass current $I_2$, however, is evidently proportional to the voltage drop across the collector-emitter section of the balancing transistor Qbp. This voltage drop, however, is the larger, the lower impedant the lamp La is compared to the other channels. This then results in a larger reduction in the setpoint value of the lamp current $I_L$ the lower impedant the lamp is. This is exactly the desired behavior as described above.

Figure 6:
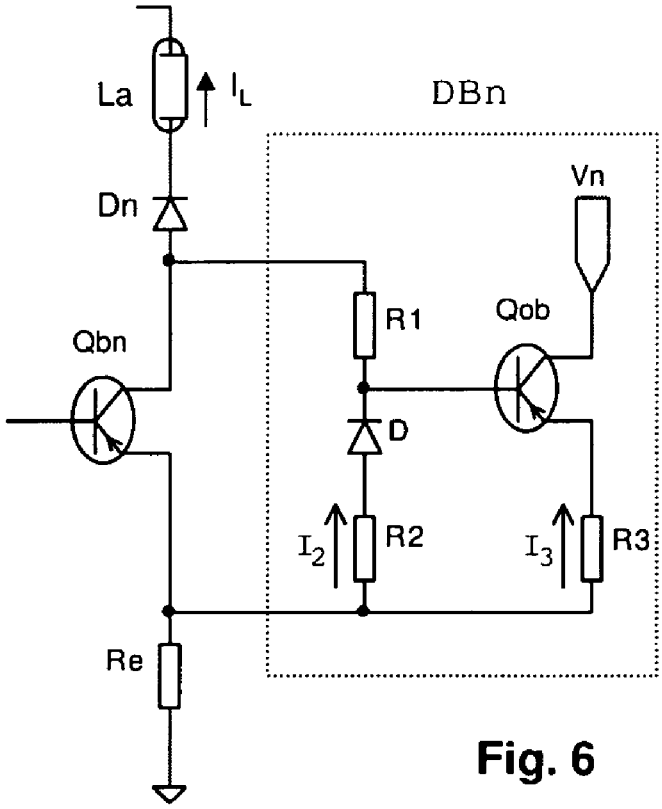
FIG. 6 shows an exemplary design of a current balancing circuit having a debalancing module.

An analogous circuit having the same functionality also exists for the pnp balancing transistors Qbn that regulate the negative half cycle of the lamp current. The respective circuit is shown in FIG. 6. In contrast to FIG. 5, the currents flow in the opposite direction.

Figure 7:
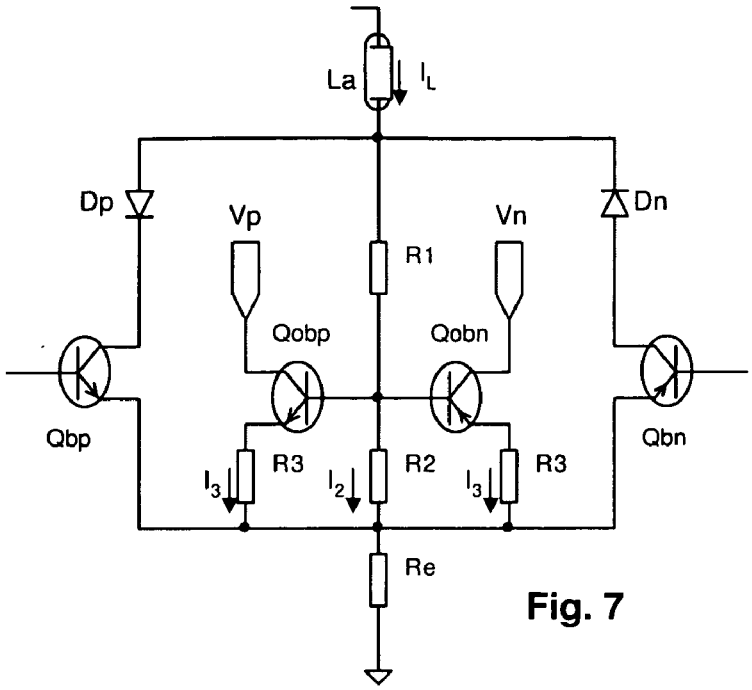
FIG. 7 shows an exemplary design of a current balancing circuit having a simplified debalancing module.

Since operation does not require high precision of the current mirror, diode D can also be omitted for many applications. When for purposes of current balancing, npn and pnp transistors are employed separately for each half cycle of the lamp current, the simplified circuit shown in FIG. 7 may be used. Qbp and Qbn are the balancing transistors for the positive and for the negative current half cycles.

The debalancing module consists of a voltage divider formed by the resistors R1 and R2 that bypass a bypass current $I_2$ around the collector-emitter section of the transistors Qbp and Qbn. The bypass current is reflected by two current mirror circuits formed by the transistors Qobp and Qobn and the resistors R3 and generates a mirror current $I_3$. The mirror currents are conducted via the resistor Re. Since the balancing transistors regulate the overall current through Re, the lamp current $I_L$ is reduced by the amount of the currents $I_3$ fed in via the current mirror.

Figure 8:
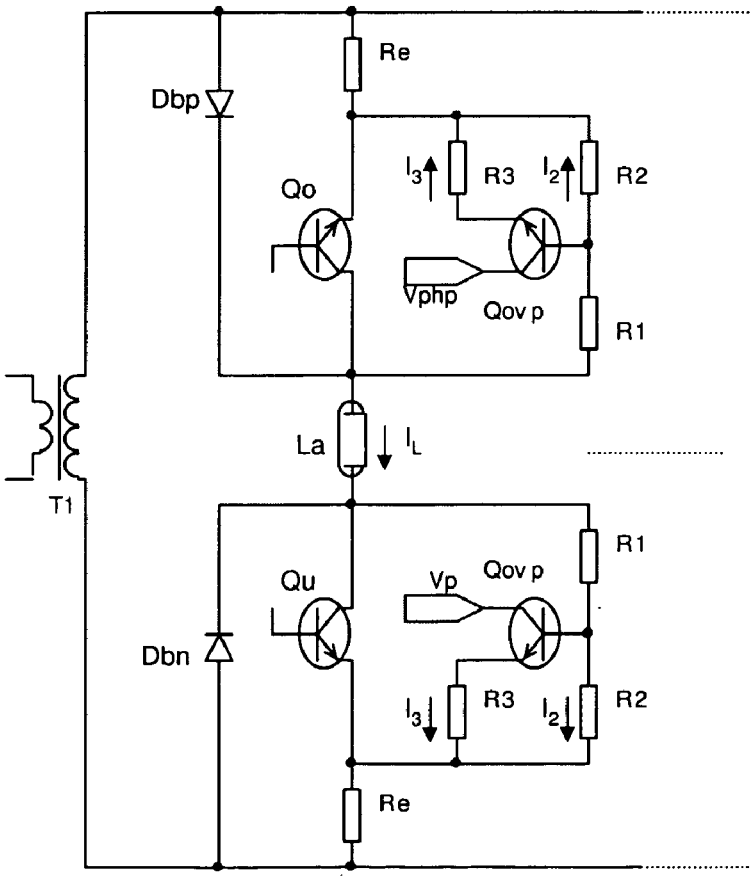
FIG. 8 shows a current balancing circuit having debalancing modules using NPN transistors solely.

If npn balancing transistors Qb are to be solely used in the circuit, the circuit shown in FIG. 8 can be employed. This now evidently requires auxiliary voltage sources Vp, Vphp on each side of the lamp. Regulation of the lamp current $I_L$ is carried out separately for each half cycle of the input alternating current. The diodes Dbp and Dbn are protective diodes that conduct the half cycles of the input alternating current via the lamp La to the respective "responsible" transistor.

The invention claimed is:

1. An electronic circuit for operating a plurality of gas discharge lamps (La) across a common voltage source (U~) having a current balancing circuit for defined current distribution between the plurality of gas discharge lamps (La), characterized in that each lamp (La) is associated with at least one debalancing module (DBp, DBn) that debalances the individual lamp currents ($I_L$) through the gas discharge lamps in a controlled way such that the setpoint value of the current flowing through each lamp increases monotonically with the impedance of the lamp.

2. An electronic circuit according to claim 1, characterized in that in the current balancing circuit a: the alternating current ($I_L$) through each lamp (La) is separated using diodes (Dp, Dn) into its positive and negative half cycles and b: the positive half cycle is conducted back via the collector-emitter section of an npn transistor (Qbp) and an emitter resistor (Re) to the ac voltage source, and c: the negative half cycle is conducted back via the collector-emitter section of an pnp transistor (Qbn) and an emitter resistor (Re) to the voltage source, and d: the base terminals of all npn transistors (Qbp) are electrically connected to one another and e: the base terminals of all pnp transistors (Qbn) are electrically connected to one another and f: the common base currents for the transistors (Qbp; Qbn) derived from the lamp current of a gas discharge lamp (La) have to overcome a potential step.

3. An electronic circuit according to claim 2, characterized in that each of the transistors (Qbp, Qbn, Qu, Qo) has an electronic component or a circuit part between the base and collector terminal that generates a voltage potential step and has high impedance below a specific voltage potential and low impedance above this level.

4. An electronic circuit according to claim 1, characterized in that in the current balancing circuit a: for each gas discharge lamp (La), a half cycle of the input alternating current is conducted via a first diode (Dbp) through the lamp (La) and a first transistor (Qu) and the other half cycle is conducted via a second diode (Dbn) through the lamp (La) and a second transistor (Qo), and b: the base terminals of all first transistors (Qu) are electrically connected to one another and c: the base terminals of all second transistors (Qo) are electrically connected to one another and d: the common base currents of the transistors (Qu, Qo) derived from the lamp current of a gas discharge lamp (La) have to overcome a potential step.

5. An electronic circuit according to claim 4, characterized in that, the current ($I_L$) through each lamp (La) flows via at least one transistor (Qbp, Qbn, Qo, Qu) connected in series to the lamp and one emitter resistor (Re) connected to the emitter terminal of the transistor, and at the emitter terminal of the transistor (Qbp, Qbn, Qo, Qu), an additional current ($I_3$) from an external source is fed in, wherein this current ($I_3$) is increased monotonically with the voltage drop across the collector-emitter section of the transistor (Qbp, Qbn, Qo, Qu).

6. An electronic circuit according to claim 4, characterized in that a voltage divider consisting of resistors (R1, R2) is connected in parallel to the collector-emitter section of the transistor (Qbp, Qbn, Qo, Qu), the voltage divider generating a bypass current ($I_2$) that is proportional to the collector-emitter voltage of the transistor, wherein the bypass current ($I_2$) is conducted to a current mirror circuit consisting of at least one transistor (Qob, or Qobp, Qobn, Qovp) and one resistor (R3), by means of which the additional current ($I_3$) is generated from an auxiliary voltage source and fed into the emitter terminal of the transistor (Qbp, Qbn or Qo, Qu).

7. An electronic circuit according to claim 1, characterized in that the lamps (La) are supplied from an ac voltage source (U~) and the positive and the negative half cycles of the ac voltage are debalanced separately.

8. An electronic circuit according to claim 1, characterized in that the lamps (La) are supplied from a dc voltage source, wherein the circuit is then dimensioned for only one polarity.

9. A method for operating a plurality of gas discharge lamps (La) across a common voltage source using a current balancing circuit for defined current distribution between the plurality of gas discharge lamps (La), characterized in that for each lamp (La) at least one debalancing module (DBp, Dbn) is used that debalances the individual lamp currents ($I_L$) through the gas discharge lamps in a controlled way such that the setpoint value of the current ($I_L$) flowing through each lamp increases monotonically with the impedance of the lamp.

* * * * *